US008410033B2

(12) United States Patent
Zhou et al.

(10) Patent No.: US 8,410,033 B2
(45) **Date of Patent: *Apr. 2, 2013**

(54) PREPARATION OF DIESTER-BASED BIOLUBRICANTS FROM MONOESTERS OF FATTY ACIDS AND OLEFIN-DERIVED VICINAL DIOLS

(75) Inventors: Zhen Zhou, Emeryville, CA (US); Stephen Joseph Miller, San Francisco, CA (US); Saleh A. Elomari, Fairfield, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 176 days.

This patent is subject to a terminal disclaimer.

(21) Appl. No.: 12/869,253

(22) Filed: Aug. 26, 2010

(65) Prior Publication Data

US 2012/0053099 A1 Mar. 1, 2012

(51) Int. Cl.

| | |
|---|---|
| ***C07C 69/34*** | (2006.01) |
| ***C07C 55/02*** | (2006.01) |
| ***C10M 105/36*** | (2006.01) |
| ***C12P 7/62*** | (2006.01) |

(52) U.S. Cl. ..... 508/465; 508/496; 508/506; 435/135

(58) Field of Classification Search ..... 508/465, 508/496, 459, 506; 435/135

See application file for complete search history.

(56) References Cited

U.S. PATENT DOCUMENTS

| | | | | |
|---|---|---|---|---|
| 2,492,201 | A | 12/1949 | Swern et al. | |
| 2,537,283 | A | 1/1951 | Schaad | |
| 3,211,801 | A | 10/1965 | Holm et al. | |
| 3,270,085 | A | 8/1966 | Noddings et al. | |
| 3,304,343 | A | 2/1967 | Mitsutani | |
| 3,327,014 | A | 6/1967 | Noddings | |
| 3,448,164 | A | 6/1969 | Holm et al. | |
| 3,723,564 | A | 3/1973 | Tidwell et al. | |
| 4,217,287 | A | 8/1980 | Wu et al. | |
| 4,593,146 | A | 6/1986 | Johnson et al. | |
| 6,281,404 | B1 | 8/2001 | Miller | |
| 6,774,091 | B2 * | 8/2004 | Dituro et al. | 508/168 |
| 2008/0194444 | A1 | 8/2008 | Miller et al. | |
| 2009/0159837 | A1 * | 6/2009 | Kramer et al. | 252/68 |
| 2009/0198075 | A1 * | 8/2009 | Miller et al. | 549/523 |
| 2009/0285728 | A1 * | 11/2009 | Miller | 422/187 |
| 2010/0120642 | A1 | 5/2010 | Miller et al. | |

OTHER PUBLICATIONS

Dry, "The Fischer-Tropsch process: 1950-2000," vol. 71(3-4), pp. 227-241, 2002.

Schulz, "Short history and present trends of Fischer-Tropsch synthesis," Applied Catalysis A, vol. 186, pp. 3-12, 1999.

Swern et al., "Epoxidation of Oleic Acid, Methyl Oleate and Oleyl Alcihol with Perbenzoic Acid," J. Am. Chem. Soc., vol. 66(11), pp. 1925-1927, 1944.

(Continued)

*Primary Examiner* — Cephia D Toomer
*Assistant Examiner* — Vishal Vasisth
(74) *Attorney, Agent, or Firm* — Jeffrey M. McQuiston

(57) ABSTRACT

The present invention is generally directed to methods of making diester-based (bio)lubricant compositions, wherein such diester-based lubricant compositions generally comprise diester species prepared by reacting vicinal diol species with monoester(s) of one or more fatty acids. In some embodiments, such methods for making such diester-based lubricants utilize one or more biomass precursor species (e.g., monoesters of fatty acids derived from crop oils and/or other source of triglyceride species such as algae). In some embodiments, such diester-based lubricants are derived from Fischer-Tropsch (FT) olefins, typically alpha (α)-olefins.

11 Claims, 2 Drawing Sheets

OTHER PUBLICATIONS

Sharpless et al., "Osmium Catalyzed Vicinal Hydroxylation of Olefins by tert-Butyl Hydroperoxide under Alkaline Conditions," J. Am. Chem. Soc., vol. 98(7), pp. 1986-1987, 1976.
Parker et al., "Mechanisms of Epoxide Reactions," Chem. Rev. vol. 59, pp. 737-799, 1959.
Höfle et al., "4-Dialkylaminopyradines as Highly Active Acylation Catalysts," Angew. Chem. Int. Ed. Engl., vol. 17, pp. 569-583, 1978.
Paterson et al., "*meso* Epoxides in Asymetric Synthesis: Enantioselective Opening by Nucleophiles in the Presence of Chiral Lewis Acids,"Angew. Chem. Int. Ed., vol. 31, pp. 1179-1180, 1992.

* cited by examiner (10)

(11)

(12)

(13)

(14)

PREPARATION OF DIESTER-BASED BIOLUBRICANTS FROM MONOESTERS OF FATTY ACIDS AND OLEFIN-DERIVED VICINAL DIOLS

FIELD OF THE INVENTION

This invention relates to methods of making ester-based lubricants, and specifically to methods of synthesizing and/or formulating diester-based lubricants—particularly wherein any such synthesis involves reaction of a vicinal diol with a monoester of a fatty acid.

BACKGROUND

Esters can have wide applicability in lubricant formulations, and esters have been used as lubricating oils for over 50 years. They are used in a variety of applications ranging from jet engines to refrigeration. In fact, esters were the first synthetic crankcase motor oils in automotive applications. However, esters gave way to polyalphaolefins (PAOs) due to the lower cost of PAOs and their formulation similarities to mineral oils. In fully synthetic motor oils, however, esters are almost always used in combination with PAOs to balance the effect on seals, additive solubility, volatility reduction, and energy efficiency improvement by enhanced lubricity.

Ester-based lubricants, in general, have excellent lubrication properties due to the polarity of the ester molecules of which they are comprised. The polar ester groups of such molecules adhere to positively-charged metal surfaces creating protective films which slow down the wear and tear of the metal surfaces. Such lubricants are less volatile than the traditional lubricants and tend to have much higher flash points and much lower vapor pressures. Ester lubricants are excellent solvents and dispersants, and can readily solvate and disperse the degradation by-products of oils. Therefore, they greatly reduce sludge buildup. While ester lubricants are stable to thermal and oxidative processes, the ester functionalities give microbes a handle with which to do their biodegrading more efficiently and more effectively than their mineral oil-based analogues—thereby rendering them more environmentally-friendly. However, the preparation of esters is more involved and more costly than the preparation of their PAO counterparts.

Recently, novel diester-based lubricant compositions (i.e., lubricant compositions comprising diester species) and their corresponding syntheses have been described in the following commonly-assigned patent publication: Miller et al., United States Patent Application Publication No. 20080194444 A1, published Aug. 14, 2008. The synthetic routes described in this patent by Miller et al. (2008) application comprise and/or generally proceed through the following sequence of reaction steps: (1) epoxidation of an olefin to form an epoxide; (2) conversion of the epoxide to form a diol; and (3) esterification of the diol with an esterification agent (e.g., carboxylic acid, acyl halide, and/or acyl anhydride) to form a diester.

In view of the foregoing, and not withstanding such above-described advances in diester-based lubricant synthesis, an alternative method of generating ester-based lubricants would be extremely useful—particularly wherein such methods afford variability in reactant species and product.

BRIEF DESCRIPTION OF THE INVENTION

The present invention is generally directed to methods of making diester-based lubricant compositions, wherein such compositions comprise a diester species synthesized by reacting monoesters of fatty acids with olefin-derived vicinal diols. In some such embodiments, the methods for making such diester-based lubricants utilize a biomass precursor (or use reactants derived from biomass, e.g., crop oil-derived monoesters of fatty acids). In these or other embodiments, lubricant precursor species (i.e., species used to make the lubricant composition) can also be sourced or otherwise derived from Fischer-Tropsch (FT) reaction products (e.g., olefins).

In some embodiments, the present invention is directed to one or more processes (methods) for making diester-based biolubricants, such processes generally comprising the steps of: (a) converting an olefin having a carbon number of from 6 to 30 to a vicinal diol, the vicinal diol (I) having the same carbon number as the olefin from which it is derived and having a general formula:

(I)

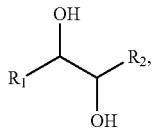

where $R_1+R_2$ contain from 4 to 28 carbon atoms (i.e., the hydrocarbon groups collectively have a carbon number of 4 to 28); and (b) esterifying the diol with monoester (II) to form a diester species (III) via transesterification, the diester species (III) having viscosity and pour point suitable for use as a lubricant, the monoester (II) having a general formula:

(II)

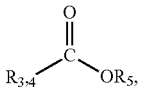

where $R_{3,4}$ is a $C_2$ to $C_{17}$ hydrocarbon group, and where $R_5$ is a $C_1$ to $C_6$ hydrocarbon group, and the diester species (III) having the following structure:

(III)

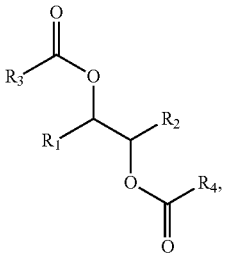

where $R_1$, $R_2$, $R_3$, and $R_4$ are the same or independently selected from $C_2$ to $C_{17}$ hydrocarbon groups, with the caveat that $R_1+R_2$ may not contain more than 28 carbon atoms.

In some such above-described processes, the diol is produced in a sub-process of a first type, said sub-process comprising the sub-steps of: (a) epoxidizing the internal olefin to form an epoxide; and (b) hydrolyzing the epoxide to form a diol. In some or other such above-described processes, the diol is produced in a sub-process of a second type, the second type of sub-process comprising the sub-steps of: (a') formylating (hydroxyformylating) the internal olefin to form a hydroxyformate; and (b') hydrolyzing the hydroxyformate to yield a diol.

The foregoing has outlined rather broadly the features of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

1. Introduction

Figure 1:
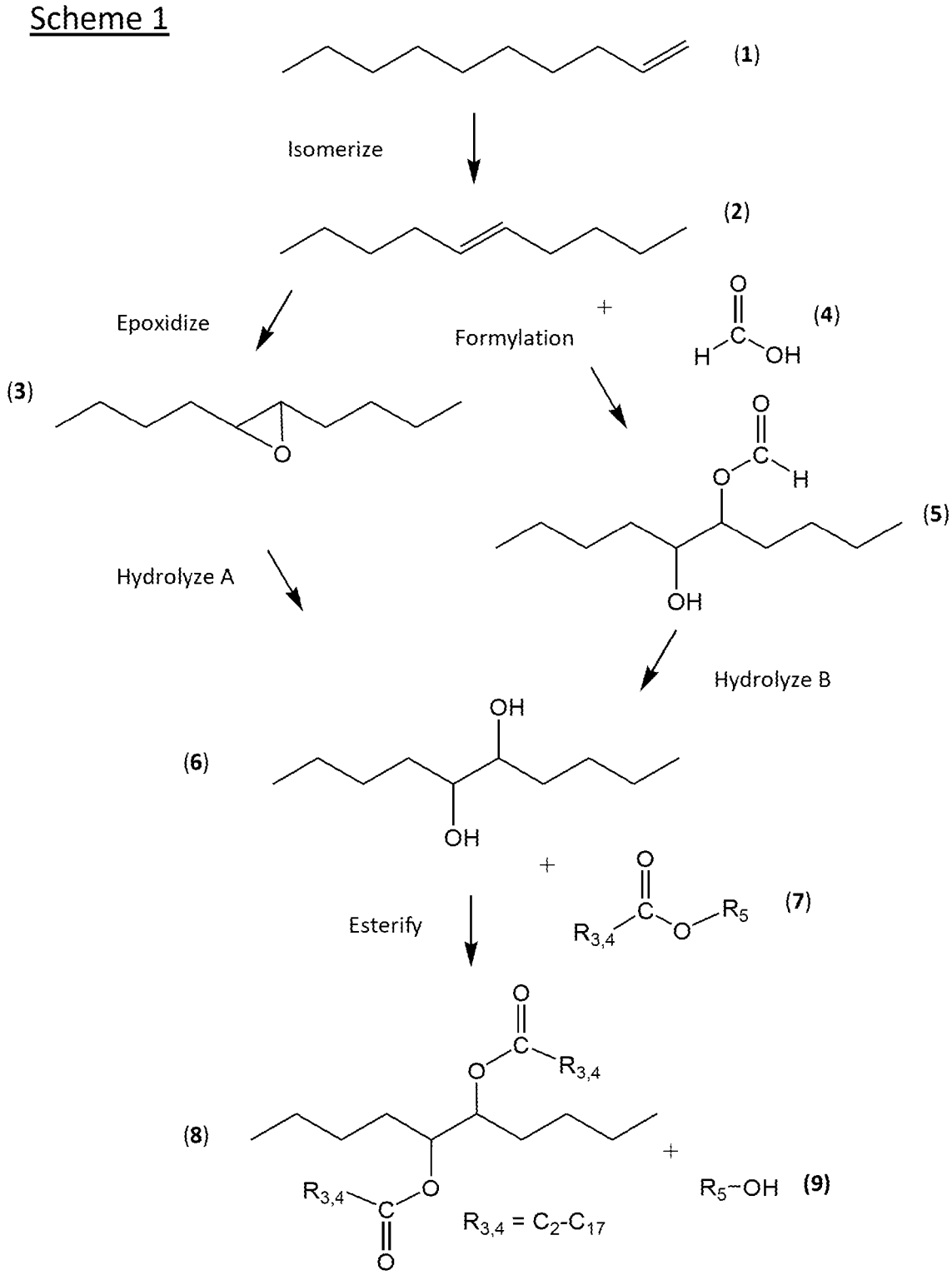
FIG. 1 (Scheme 1) is a chemical flow diagram illustrating an exemplary method of making a diester-based lubricant composition (or component thereof) by reacting monoesters of fatty acids with olefin-derived vicinal diols, in accordance with some embodiments of the present invention.

As mentioned in a preceding section, the present invention is directed to methods of making diester-based lubricant compositions comprising diester species prepared by reacting vicinal diol species with monoester(s) of one or more fatty acids. In some embodiments, such methods for making such diester-based lubricants utilize one or more biomass precursor species (e.g., monoesters of fatty acids derived from crop oils and/or other sources of triglyceride species such as algae). In some embodiments, such diester-based lubricants comprise diester species that are at least partially derived from Fischer-Tropsch (FT) olefins, typically alpha (α)-olefins.

Because biolubricants and biofuels are increasingly capturing the public's attention and becoming topics of focus for many in the oil industry, the use of biomass in the making of such above-mentioned lubricants, could be attractive from several different perspectives. To the extent that biomass is so utilized in the making of the diester-based lubricants of the present invention, such lubricants are deemed to be biolubricants.

2. Definitions

Lubricants," as defined herein, are substances (usually a fluid under operating conditions) introduced between two moving surfaces so to reduce the friction and wear between them. This definition is intended to be inclusive of greases, whose viscosity drops dramatically upon application of shear.

"Diester-based," as used herein in reference to lubricant compositions, implies that such lubricant compositions comprise diester species, and that such lubricant compositions exhibit properties imparted by the diester species contained or Otherwise present therein.

Herein, "base oil" will be understood to mean the single largest component (by weight) of a lubricant composition. Base oils are categorized into five groups (I-V) by the American Petroleum Institute (API). See API Publication Number 1509. The API Base Oil Category, as shown in the following table (Table 1), is used to define the compositional nature and/or origin of the base oil.

TABLE 1

| Base Oil Category | Sulfur (%) | | Saturates (%) | Viscosity Index |
|---|---|---|---|---|
| Group I | >0.03 | and/or | <90 | 80 to 120 |
| Group II | <0.03 | and | >90 | 80 to 120 |
| Group III | <0.03 | and | >90 | >120 |
| Group IV | All polyalphaolefins (PAOs) | | | |
| Group V | All others not included in Groups I, II, III or IV (e.g., esters) | | | |

"Mineral base oils." as defined herein, are those base oils produced by the refining of a crude oil.

"Pour point," as defined herein, represents the lowest temperature at which a fluid will pour or flow. See, e.g., ASTM International Standard Test Method D 5950-02 (R 2007).

"Cloud point," as defined herein, represents the temperature at which a fluid begins to phase separate due to crystal formation. See, e.g. ASTM Standard Test Method D 5771-05.

"Centistoke," abbreviated "cSt," is a unit for kinematic viscosity of a fluid (e.g., a lubricant), wherein 1 centistoke equals 1 millimeter squared per second (1 cSt=1 $mm^2/s$). See, e.g., ASTM Standard Guide and Test Method D 2270-04. Herein, the units cSt and $mrn^2/s$ are used interchangeably.

With respect to describing molecules and/or molecular fragments herein, "$R_m$" where "m" is an index, refers to a hydrocarbon group, wherein the molecules and/or molecular fragments can be linear and/or branched.

As defined herein, "$C_n$," where "n" is an integer, describes a hydrocarbon molecule or fragment (e.g., an alkyl group) wherein "n" denotes the number of carbon atoms in the fragment or molecule.

The term "carbon number" is used herein in a manner analogous to that of "$C_n$." A difference, however, is that carbon number refers to the total number of carbon atoms in a molecule (or molecular fragment) regardless of whether or not it is purely hydrocarbon in nature. Linoleic acid, for example, has a carbon number of 18.

The term "internal olefin," as used herein, refers to an olefin (i.e., an alkene) having a non-terminal carbon-carbon double bond (C═C). This is in contrast to "α-olefins" which do bear a terminal carbon-carbon double bond.

"Isomeric mixtures," as defined herein, refers to a mixture of quantities of at least two different molecular species having the same chemical formula and molecular weight, but having a different structural arrangements—in terms of the atoms making up the at least two different molecular species.

The term "vicinal," as used herein, refers to the attachment of two functional groups (substituents) to adjacent carbons in a hydrocarbon-based molecule, e.g., vicinal diesters.

The term "fatty acid moiety," as used herein, refers to any molecular species and/or molecular fragment comprising the acyl component of a tatty (carboxylic) acid.

The prefix "bio," as used herein, refers to an association with a renewable resource of biological origin, such as resource generally being exclusive of fossil fuels. Such an association is typically that of derivation, i.e., a bio-ester derived from a biomass precursor material.

"Fischer-Tropsch products," as defined herein, refer to molecular species derived from a catalytically-driven reaction between CO and $H_2$ (i.e., "syngas"). See, e.g., Dry, "The Fischer-Tropsch process: 1950-2000," vol. 71(3-4), pp. 227-241, 2002; Schulz, "Short history and present trends of Fischer-Tropsch synthesis," Applied Catalysis A, vol. 186, pp. 3-12, 1999; Claeys and Van Steen, "Fischer-Tropsch Technology," Chapter 8, pp. 623-665, 2004.

"Gas-to-liquid" or "GTL," as used herein, refers to Fischer-Tropsch processes for generating liquid hydrocarbons and hydrocarbon-based species (e.g., oxygenates).

3. Methods of Making Diester Lubricants

As mentioned above, the present invention is generally directed to methods of making diester-based lubricant compositions (i.e., lubricant compositions comprising diester species (III)).

In some embodiments, the present invention is directed to one or more processes (methods) comprising the steps of (a) converting an olefin having a carbon number of from 6 to 30 to a vicinal diol, the vicinal diol (I) having the same carbon number as the olefin from which it is derived and having a general formula:

(I)

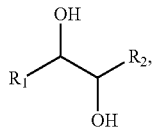

where $R_1+R_2$ contain from 4 to 28 carbon atoms (i.e., collectively have a carbon number of 4 to 28); and (b) esterifying the diol with monoester (II) to form a diester species (III) via transesterification, the diester species (III) having viscosity and pour point suitable for use as a lubricant, the monoester (II) having a general formula:

(II)

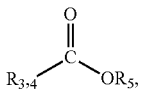

where $R_{3,4}$ ($R_3$ and $R_4$ can be the same or different) is a $C_2$ to $C_{17}$ hydrocarbon group, and where $R_5$ is a $C_1$ to $C_6$ hydrocarbon group, and the diester species (III) having the following structure:

(III)

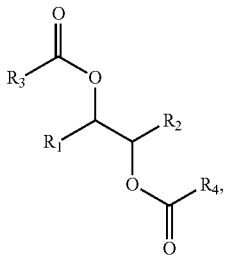

where $R_1$, $R_2$, $R_3$, and $R_4$ are the same or independently selected from $C_2$ to $C_{17}$ hydrocarbon groups, with the caveat that $R_1+R_2$ may not contain more than 20 carbon atoms. In some such embodiments, such lubricant compositions comprising diester species have a viscosity of 3 centistokes (cSt) or more at a temperature of 100° C.

Note that because two monoester species (II) are reacted with diol species (I), $R_{3,4}$ collectively denotes $R_3$ and $R_4$ hydrocarbon chains that can be the same or different.

Regarding the above-described process for making diester species (III), those of skill in the art will appreciate that such processes will typically involve reacting a plurality of species (I) and (II) to yield a plurality of diester species (III). Furthermore, depending on the degree of homogeneity (i.e., molecular similarity) among each of the plurality of reactant species (including the olefin starting material); there exists a considerable range of homogeneity for the plurality of diester species (III) produced.

In some embodiments, diester species (III) (i.e., a substantially homogenous or inhomogenous plurality of such species) is mixed or admixed with a base oil (base stock) selected from the group consisting of gas-to-liquids (GTL) base oils, mineral base oils, and diester-based base oils. In some or other embodiments, the diester species itself can serve as a base oil (i.e., it can represent the single largest component of the lubricant composition).

In some such above-described method embodiments, some or all of the olefin used is a reaction product of a Fischer-Tropsch (FT) process, wherein such olefins are deemed to be "FT-derived." In some or other embodiments, the olefin used is derived from the pyrolysis of waste plastic (vide supra). Generally speaking, however, the source of the olefin(s) is not particularly limited.

In some embodiments, the olefin is an α-olefin (i.e., an olefin having a double bond at a chain terminus). In such embodiments, it is often necessary to isomerize (via a step of isomerizing) the olefin so as to internalize the double bond. Such isomerization is typically carried out catalytically using a catalyst such as, but not limited to, crystalline aluminosilicate and like materials and aluminophosphates. See, e.g. Schaad, U.S. Pat. No. 2,537,283, issued Jan. 9, 1951; Holm et al., U.S. Pat. No. 3,211,801, issued Oct. 12, 1965; Noddings et al., U.S. Pat. No. 3,270,085, issued Aug. 30, 1966; Noddings, U.S. Pat. No. 3,327,014, issued Jan. 20, 1967; Mitsutani, U.S. Pat. No. 3,304,343, issued Feb. 14, 1967; Holm et al., U.S. Pat. No. 3,448,164, issued Sep. 21, 1967; Johnson et al., U.S. Pat. No. 4,593,146, issued Jun. 3, 1986; Tidwell et al., U.S. Pat. No. 3,723,564, issued Mar. 27, 1973; and Miller, U.S. Pat. No. 6,281,404, issued Aug. 28, 2001; the last of which claims a crystalline aluminophosphate-based catalyst with 1-dimensional pores of size between 3.8 Å and 5 Å.

In converting the above-mentioned (possibly internalized) olefin to a diol, a number of possible synthetic routes are available. While not exhaustive of all such possibilities, examples of such synthetic routes can be found in, e.g., the following references: Swern et al., "Epoxidation of Oleic Acid, Methyl Oleate and Oleyl Alcohol with Perbenzoic Acid," J. Am. Chem. Soc., vol. 66(11), pp. 1925-1927, 1944; Swern et al., U.S. Pat. No. 2,492,201, issued Dec. 27, 1949; Sharpless et al. J. Am. Chem. Soc., vol. 98(7), pp. 1986-1987, 1976; and Wu et al., U.S. Pat. No. 4,217,287, issued Aug. 12, 1980.

Two exemplary synthetic routes for converting (i.e., dihydroxylating) olefins to diols are highlighted here. In a first exemplary synthetic route (dihydroxylation of a first type), the olefin is first epoxidized to yield an epoxide, the epoxide subsequently being hydrolyzed to yield a diol (see, e.g., Swern et al., "Epoxidation of Oleic Acid, Methyl Oleate and Oleyl Alcohol with Perbenzoic Acid," J. Am. Chem. Soc., vol. 66(11), pp. 1925-1927, 1944). In a second exemplary synthetic route (dihydroxylation of a second type), the olefin is reacted with hydrogen peroxide ($H_2O_2$) (or perhaps some other organic peroxide or hydroperoxide) in the presence of formic acid (CH(O)OH) to yield a hydroxyformate species (i.e., the product of a formylation process), the hydroxyformate species being subsequently hydrolyzed to yield the diol (see, e.g., Osterholt et. al., 2008). Notwithstanding the preceding comments, preparation of the diol is not particularly limited, and those of skill in the art will recognize that variations and altogether different synthetic routes exist for converting olefins to diols (vide supra).

With respect to such above-described dihydroxylations of a first type, in some embodiments the hydrolysis of the epoxide to a diol occurs in the presence of a catalyst—typically an acid or base catalyst. Exemplary acid catalysts include, but are not limited to, mineral-based Brönsted acids (e.g., HCl, $H_2SO_4$, $H_3PO_4$, perhalogenates, etc.), Lewis acids (e.g., $TiCl_4$ and $AlCl_3$) solid acids such as acidic aluminas and silicas or their mixtures, and the like. See, e.g., Parker et al., "Mechanisms of Epoxide Reactions," Chem. Rev. vol. 59, pp. 737-799, 1959; and Paterson et al., "meso Epoxides in Asymetric Synthesis: Enantioselective Opening by Nucleophiles in the Presence of Chiral Lewis Acids," Angew. Chem. Int. Ed., vol. 31, pp. 1179-1180, 1992. Based-catalyzed hydrolysis typically involves the use of bases such as aqueous solutions of sodium or potassium hydroxide.

Further with respect to such above-described dihydroxylations of a first type, in some or other such embodiments the epoxidation of the olefin is facilitated by one or more enzymes. Enzyme-facilitated epoxidation of olefins is described in Miller et al., United States Patent Application Publication No. 20100120642 A1, published May 13, 2010.

Regarding the step of esterifying (i.e., esterifying the diol with a monoester of a fatty acid to form a diester), in some such above described embodiments, the esterification is catalyzed by a metal salt. In some such embodiments, the metal salt is an alkali metal salt. Examples of such metal salts include, but are not limited to, (alkali) metal alkoxides (e.g., sodium methoxide) and (alkali) metal carbonates (e.g., potassium carbonate).

Generally speaking, the above-described esterification (i.e., introduction of ester groups) introduces branching into the parent olefin, wherein such branching can enhance the viscosity and cold temperature properties (i.e., pour and cloud points) of the lubricant composition in which it is employed. Furthermore, viscosity and cold temperature properties can be controlled, modulated, and/or modified by changing the length of the parent olefin and the chain length of the fatty acid tail of the monoester (II).

In some of the above-described embodiments, the diester-based lubricant composition comprises diester species selected from the group consisting of decanoic acid 2-decanoyloxy-1-hexyl-octyl ester and its isomers, tetradecanoic acid 1-hexyl-2-tetradecanoyloxy-octyl esters and its isomers, dodecanoic acid 2-dodecanoyloxy-1-hexyl-octyl ester and its isomers, hexanoic acid 2-hexanoyloxy-1-hexyl-octyl ester and its isomers, octanoic acid 2-octanoyloxy-1-hexyl-octyl ester and its isomers, hexanoic acid 2-hexanoyloxy-1-pentyl-heptyl ester and isomers, octanoic acid 2-octanoyloxy-1-pentyl-heptyl ester and isomers, decanoic acid 2-decanoyloxy-1-pentyl-heptyl ester and isomers, decanoic acid 2-decanoyloxy-1-pentyl-heptyl ester and its isomers, dodecanoic acid 2-dodecanoyloxy-1-pentyl-heptyl ester and isomers, tetradecanoic acid 1-pentyl-2-tetradecanoyloxy-heptyl ester and isomers, tetradecanoic acid 1-butyl-2-tetradecanoyloxy-hexyl ester and isomers, dodecanoic acid 1-butyl-2-dodecanoyloxy-hexyl ester and isomers, decanoic acid 1-butyl-2-decanoyloxy-hexyl ester and isomers, octanoic acid 1-butyl-2-octanoyloxy-hexyl ester and isomers, hexanoic acid 1-butyl-2-hexanoyloxy-hexyl ester and isomers, tetradecanoic acid 1-propyl-2-tetradecanoyloxy-pentyl ester and isomers, dodecanoic acid 2-dodecanoyloxy-1-propyl-pentyl ester and isomers, decanoic acid 2-decanoyloxy-1-propyl-pentyl ester and isomers, octanoic acid 2-octanoyloxy-1-propyl-pentyl ester and isomers, hexanoic acid 2-hexanoyloxy-1-propyl-pentyl ester and isomers, and mixtures thereof.

In some such above-described process embodiments, there further comprises a step of blending the diester species with an additive component. Depending on the diester component and the lubricant application, such an additive component can comprise at least one additive selected from the group consisting of antioxidants, detergents, anti-wear agents, metal deactivators, corrosion inhibitors, rust inhibitors, friction modifiers, anti-foaming agents, viscosity index improvers, demulsifying agents, emulsifying agents, tackifiers, complexing agents, extreme pressure additives, pour point depressants, and combinations thereof.

Regarding such above-described additives, in some embodiments, all or part of the additive component is provided as an additive package. In some or other embodiments, some or all of the diester component is combined with some or all of the additive component to collectively form an additive package. In some embodiments, the quantity of diester component, or a portion thereof, serves to facilitate dispersion of all or part of the additive component into the base oil. For more on the variety of lubricant additives that exist, and on the properties they impart, see, e.g., Rudnick, L. R. *Lubricant Additives: Chemistry and Applications,* $2^{nd}$ ed., CRC Press, Boca Raton, 2009.

It is perhaps worth reiterating that, for many applications, the above-described diester compositions are unlikely to be used as lubricants by themselves, but are usually used as blending stocks. As such, esters with higher pour points may also be used as blending stocks with other lubricant oils since they are very soluble in hydrocarbons and hydrocarbon-based oils.

To facilitate understanding of the present invention, attention is directed to Scheme 1 (FIG. 1), whereby a quantity of an exemplary Fischer-Tropsch α-olefin (or alternatively-derived α-olefin) (1) can be isomerized to the corresponding internal olefin (2). Dihydroxylation can be of either a first type or a second type, whereby the first type involves epoxidation of internal olefin (2) to yield epoxide (3) that can be subsequently hydrolyzed (Hydrolyze A) to yield vicinal diol (6), and whereby the second type involves formylating (hydroxyformylating) internal olefin (2) by reacting it with formic acid in the presence of $H_2O_2$ to yield hydroxyformate (5) that can be subsequently hydrolyzed (Hydrolyze B) to yield vicinal diol (6). Vicinal diol (6) can then be reacted with a monoester(s) of a fatty acid (7) to yield a diester (8) and an alcohol (9). $R_{3,4}$ is generally a $C_2$-$C_{17}$ hydrocarbon, and $R_5$ is typically a $C_1$ to $C_6$ hydrocarbon.

Figure 2:
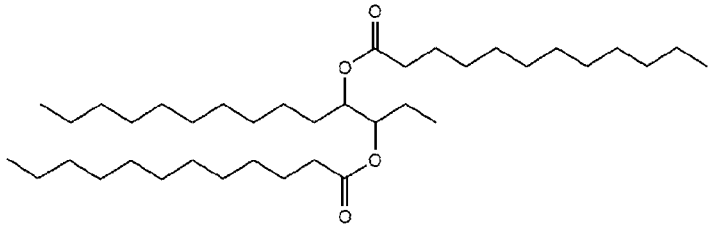
FIG. 2 depicts an exemplary mixture of species (10)-(14) that can be produced via methods of the present invention.
Figure 2:
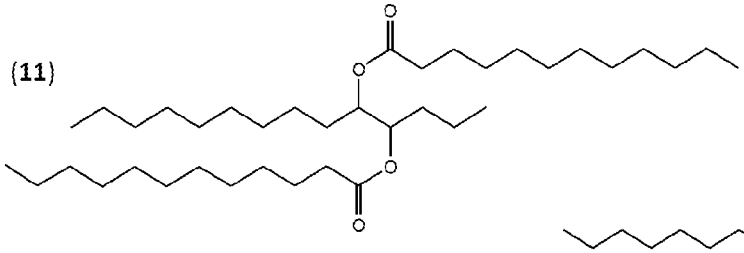
Figure 2:
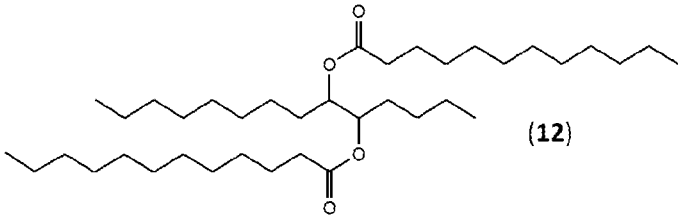
Figure 2:
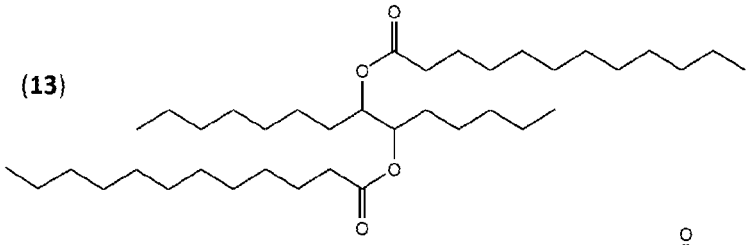
Figure 2:
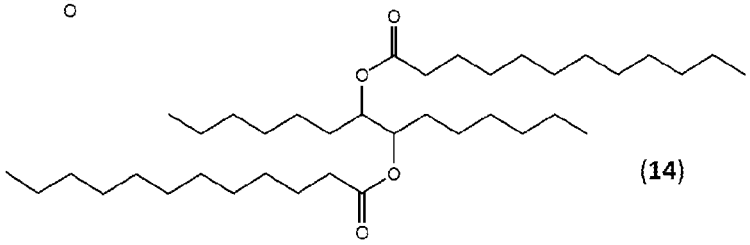

It is reiterated that the scheme shown in FIG. 1 is merely exemplary and is not intended to limit the scope of the invention described herein. Accordingly, while α-olefin (1) is shown as being a $C_{10}$ olefin, it could be longer or shorter. Additionally, it should be appreciated that in most instances species (1)-(9) exist as a plurality or quantity of such species, and that such a quantity may comprise a range of similar species (e.g., a $C_8$-$C_{12}$ range of α-olefins for (1)). Additional still, $R_{3,4}$ is intended to suggest that the two ester functionalities on a given diester can be the same or different—depending on the homogeneity of the quantity of monoester (7) from which they are derived. Shown in FIG. 2 are exemplary diester species (10)-(14) that can be made by methods of the present invention.

5. Variations

As alluded to in the preceding passages (vide supra), variations (i.e., alternate embodiments) on the above-described lubricant compositions include, but are not limited to, utilizing mixtures of isomeric olefins and or mixtures of olefins having a different number of carbons. This leads to mixtures of diester species in the product compositions, and a corresponding increase in the compositional diversity of the product lubricant.

The advantages of the methods of the present invention notwithstanding, in some variational embodiments, it may be advantageous to combine the methods of the present invention with those described in commonly-assigned United States Patent Application Publication No. 20080194444 A1, published Aug. 14, 2008, wherein esterification of the diol proceeds through an alternate process utilizing carboxylic acid(s) as the esterification agent(s).

Additional variations might include alternative sources of olefins. For example, such olefins (as a starting point for the synthesis of the above-described diester species) could be sourced or otherwise derived from the pyrolysis of waste plastic (polyethylene).

Additionally variational, in some such embodiments, at least some of the monoesters of fatty acids (fatty acid monoesters), used above in the diesterification of vicinal diols, can be produced by esterifying a fatty acid with an alcohol species, and further still, where at least one of such fatty acid and alcohol species are used in producing at least some of the fatty acid monoester used in producing at least some of the diesters found in at least some of the lubricant compositions provided herein.

6. Examples

The following examples are provided to demonstrate, and/or more fully illustrate, particular embodiments of the present invention. It should be appreciated by those of skill in the art that the methods disclosed in the examples which follow merely, represent exemplary embodiments of the present invention. However, those of skill in the art should, in light of the present disclosure, appreciate that many changes can be made in the specific embodiments described and still obtain a like or similar result without departing from the spirit and scope of the present invention.

Example 1

This Example serves to illustrate the synthesis of vicinal diols from olefins (en route to diesters for diester-based biolubricants), in accordance with some embodiments of the present invention.

In a 3-neck, 5 L reaction flask equipped with an overhead stirrer, 784 g of an isomeric mixture of tetradecenes and 1300 g of 85 wt. % formic acid (CH(O)OH)) were mixed and heated to 40° C. To the mixture, 517 g of 30 wt. % hydrogen peroxide ($H_2O_2$) was added slowly over a period of 3 hours (hrs.), and the temperature over the duration of this period was controlled so as to be in the range of 40-60° C. Once the addition of hydrogen peroxide was complete, the reaction mixture was allowed to stir for another 2 hrs. After the reaction was complete, the formic acid-aqueous solution was separated from the organic layer, and the organic layer (as an oil) was washed with 250 ml of water (2×) to remove any acid impurities. The oil was subsequently mixed with 500 g of water and heated to 60° C. At this juncture, 352 g of a 50 wt. % sodium hydroxide (NaOH) solution was added slowly to the mixture, and the temperature was maintained below 80° C. Once all of the sodium hydroxide solution was added, the mixture was allowed to stir for an additional 45-60 minutes (min.). After the reaction was complete, the water layer was separated from the (vicinal) diol product. The diol product was maintained in the liquid form by heating, and it was washed with 250 ml of hot water (2×) to remove salts and any residual base. Water was then removed by evaporation under vacuum to provide 904 g of diol product (98% yield). The produced and isolated diol was characterized by NMR spectroscopy and GC/MS.

Example 2

This Example serves to illustrate the synthesis of diesters by trans-esterification of vicinal diols (e.g., those prepared in Example 1) with monoesters of fatty acids, in accordance with some embodiments of the present invention.

A 23 g mixture of vicinal diols synthesized from an isomeric mixture of tetradecenes was mixed with 170 g of methyl laurate (methyl ester of lauric acid), and to this mixture 1.08 g of sodium methoxide ($NaOCH_3$) was quickly added. Under vacuum (~100 mmHg), the reaction mixture was stirred at 150° C. for 4 hours. To this mixture was added 200 ml of hexane, and the resulting mixture was filtered through 20 g of 60 Å silica gel. After filtration, the oil (containing the diester product) was distilled under vacuum to remove methyl laurate and 43 g of diester product was recovered (72% yield). The produced and isolated diester was characterized by NMR spectroscopy GC/MS. Properties of this diester product are shown in Table 2.

TABLE 2

| Sample | Viscosity at 40° C. | Viscosity at 100° C. | Viscosity Index | Cloud Point | Pour Point | Oxidator BN tests |
|---|---|---|---|---|---|---|
| Diester prepared in Example 2 | 22.21 cSt | 4.763 cSt | 139 | 1° C. | −27° C. | 9.98 hr. |

Example 3

This Example serves to illustrate an alternate synthesis of diesters by trans-esterification of the vicinal diols (e.g., those made in Example 1) with monoesters of fatty acids, in accordance with some embodiments of the present invention.

A 23 g diol mixture (as synthesized in Example 1) was mixed with 85 g methyl laurate, 5 g potassium carbonate and 200 ml of dimethylformamide (DMF). The reaction mixture was stirred at 160° C. for 40 hours, after which the mixture was filtered to remove the carbonate solids. After filtration, the oil (containing the diester product) was distilled under vacuum to remove methyl laurate and to thereby produce 40 g of diester product in 67% yield. The isolated diester product was subsequently characterized by NMR spectroscopy and GC/MS.

Example 4

This Example serves to illustrate the synthesis of an epoxide from an unsaturated olefin, in accordance with some embodiments of the present invention.

In a reaction vessel, 300 g of isomerized $C_{20}$-$C_{24}$ α-olefin (Chevron Phillips) was mixed with 102 g of toluene, 60 g of acetic acid, and 34 g of AMBERLITE IR120 H (Alfa Aesar). With stirring and heating at 60° C., 185 g of hydrogen peroxide (30%) solution was slowly added (dropwise) into the olefin mixture over the course of 3 hours. After addition of the olefin was complete, the mixture continued to be stirred at 60° C. for another 3 hours, after which time the reaction was complete. The epoxide product was separated from the aqueous phase and solid catalysts, and it was washed with water for several times to remove any acetic acid. Toluene was removed from the product by evaporation under reduced pressure to provide 310 g of epoxides (~98% yield). The epoxide product so produced and subsequently isolated was characterized by nuclear magnetic resonance (NMR) spectroscopy and gas-chromatography/mass spectrometry (GC/MS).

The $C_{20}$-$C_{24}$ epoxides produced above can be hydrolyzed to yield $C_{20}$-$C_{24}$ vicinal diols, which in turn can be reacted with monoesters of fatty acids to yield diester species, in accordance with embodiments of the present invention.

6. Summary

In summary, the present invention provides for methods of making diester-based lubricant compositions, wherein such diester-based lubricant compositions generally comprise vicinal diester species prepared by reacting vicinal dial species with monoester(s) of one or more fatty acids—typically in the presence of a catalyst. In some embodiments, such methods for making such diester-based lubricants utilize one or more biomass precursor species (e.g., monoesters of fatty acids derived from crop oils and/or other sources of triglyceride species). In some or other such embodiments, such diester-based lubricants are derived from Fischer-Tropsch olefins, such olefins typically being α-olefins.

All patents and publications referenced herein are hereby incorporated by reference to the extent not inconsistent herewith. It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

What is claimed:

1. A method for making diester-based biolubricants comprising diester species, said method comprising the steps of:

a) converting an olefin having a carbon number of from 6 to 30 to a vicinal diol, the vicinal diol having the same carbon number as the olefin from which it is derived and having a general formula:

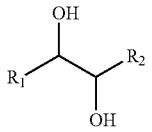

where R1 and R2 collectively contain from 4 to 28 carbon atoms, and wherein the diol is produced in a sub-process comprising the sub-steps of:

i) formylating the internal olefin to form a hydroxyformate; and ii) hydrolyzing the hydroxyformate to yield a diol; and b) esterifying the vicinal diol with monoester species to form a diester species via transesterification, said monoester having a general formula:

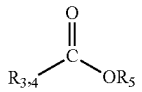

wherein R3,4 is a C2 to C17 hydrocarbon group, and wherein R5 is a C1 to C6 hydrocarbon group, and wherein the diester species has the following structure:

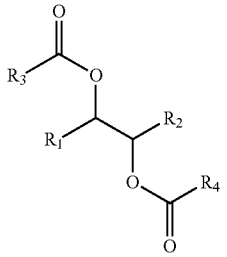

wherein the diester species has a viscosity and pour point suitable for use as a lubricant or component thereof.

2. The method of claim 1, wherein the olefin is isomerized from an α-olefin to an internal olefin in the presence of an olefin isomerization catalyst.

3. The method of claim 2, wherein the α-olefin is a Fischer-Tropsch α-olefin.

4. The method of claim 3, wherein the step of esterifying is catalyzed by an alkali metal salt.

5. The method of claim 4, wherein the alkali metal salt is a metal alkoxide.

6. The method of claim 3, wherein the monoester is derived from biomass.

7. The method of claim 6, wherein the monoester is produced from a bio-oil via a transesterification reaction between a quantity of one or more alcohol species and triglyceride species contained within said bio-oil.

8. The method of claim 3, wherein the diester species formed is selected from the group consisting of decanoic acid 2-decanoyloxy-1-hexyl-octyl ester and its isomers, tetradecanoic acid 1-hexyl-2-tetradecanoyloxy-octyl esters and its isomers, dodecanoic acid 2-dodecanoyloxy-1-hexyl-octyl ester and its isomers, hexanoic acid 2-hexanoyloxy-1-hexy-octyl ester and its isomers, octanoic acid 2-octanoyloxy-1-hexyl-octyl ester and its isomers, hexanoic acid 2-hexanoyloxy-1-pentyl-heptyl ester and isomers, octanoic acid 2-octanoyloxy-1-pentyl-heptyl ester and isomers, decanoic acid 2-decanoyloxy-1-pentyl-heptyl ester and isomers, decanoic acid 2-decanoyloxy-1-pentyl-heptyl ester and its isomers, dodecanoic acid 2-dodecanoyloxy-1-pentyl-heptyl ester and isomers, tetradecanoic acid 1-pentyl-2-tetradecanoyloxy-heptyl ester and isomers, tetradecanoic acid 1-butyl-2-tetradecanoyloxy-hexyl ester and isomers, dodecanoic acid 1-butyl-2-dodecanoyloxy-hexyl ester and isomers, decanoic acid 1-butyl-2-decanoyloxy-hexyl ester and isomers, octanoic acid 1-butyl-2-octanoyloxy-hexyl ester and isomers, hexanoic acid 1-butyl-2-hexanoyloxy-hexyl ester and isomers, tetradecanoic acid 1-propyl-2-tetradecanoyloxy-pentyl ester and isomers, dodecanoic acid 2-dodecanoyloxy-1-propyl-pentyl ester and isomers, decanoic acid 2-decanoyloxy-1-propyl-pentyl ester and isomers, octanoic acid 2-octanoyloxy-1-propyl-pentyl ester and isomers, hexanoic acid 2-hexanoyloxy-1-propyl-pentyl ester and isomers, and mixtures thereof.

9. The method of claim 3, further comprising a step of blending the diester species with a base oil so as to produce a biolubricant composition comprising diester species, said base oil being selected from the group consisting of GTL base oils, mineral base oils, diester-based base oils, and mixtures thereof.

10. The method of claim 9, further comprising a step of adding one or more additives to the biolubricant composition, said one or more additives being selected from the group consisting of antioxidants, detergents, anti-wear agents, metal deactivators, corrosion inhibitors, rust inhibitors, friction modifiers, anti-foaming agents, viscosity index improvers, demulsifying agents, emulsifying agents, tackifiers, complexing agents, extreme pressure additives, pour point depressants, and combinations thereof.

11. The method of claim 3, further comprising a step of blending one or more additional species with the diester species to yield a biolubricant composition, wherein said diester species performs as a base stock, and wherein said one or more additional species are selected from the group consisting of GTL oils, mineral oils, other diester-based oils, and one or more additives being selected from the group consisting of antioxidants, detergents, anti-wear agents, metal deactivators, corrosion inhibitors, rust inhibitors, friction modifiers, anti-foaming agents, viscosity index improvers, demulsifying agents, emulsifying agents, tackifiers, complexing agents, extreme pressure additives, pour point depressants, and combinations thereof.

* * * * *